US008841867B2

(12) United States Patent
Gilgenbach et al.

(10) Patent No.: US 8,841,867 B2
(45) Date of Patent: Sep. 23, 2014

(54) CROSSED FIELD DEVICE

(75) Inventors: Ronald M. Gilgenbach, Ann Arbor, MI (US); Yue-Ying Lau, Potomac, MD (US); David M. French, Ann Arbor, MI (US); Brad W. Hoff, Alburquerque, NM (US); John Luginsland, Ithaca, NY (US); Matthew Franzi, Chazy, NY (US)

(73) Assignee: The Regents of The University of Michigan, Ann Arbor, MI (US)

( * ) Notice: Subject to any disclaimer, the term of this patent is extended or adjusted under 35 U.S.C. 154(b) by 473 days.

(21) Appl. No.: 12/860,336

(22) Filed: Aug. 20, 2010

(65) Prior Publication Data

US 2011/0204785 A1 Aug. 25, 2011

Related U.S. Application Data

(60) Provisional application No. 61/235,812, filed on Aug. 21, 2009.

(51) Int. Cl.

| | |
|---|---|
| ***H05H 7/00*** | (2006.01) |
| ***H01J 23/02*** | (2006.01) |
| ***H01J 25/42*** | (2006.01) |

(52) U.S. Cl.

CPC *H01J 25/42* (2013.01); *H01J 23/02* (2013.01)
USPC ..... 315/501; 315/507

(58) Field of Classification Search

CPC ..... H05H 7/04; H05H 13/04; H05H 7/22; H05H 9/00; H05H 13/005; H05H 7/02; H05H 13/00; H05H 13/02; H05H 7/18; H05H 9/04; H05H 11/00; H05H 1/18; H05H 2007/002; H05H 2007/025

USPC ..... 315/501, 507, 236, 85, 267, 326, 334, 315/338, 343, 344, 348

See application file for complete search history.

(56) References Cited

U.S. PATENT DOCUMENTS

| | | | | |
|---|---|---|---|---|
| 3,305,751 | A | 2/1967 | Brown | |
| 4,413,208 | A * | 11/1983 | Morizot | 315/39.3 |
| 7,265,360 | B2 * | 9/2007 | Baker et al. | 250/393 |
| 2005/0151461 | A1 | 7/2005 | Tuck et al. | |
| 2005/0225228 | A1 | 10/2005 | Burden et al. | |
| 2009/0108729 | A1 | 4/2009 | Gorog et al. | |

OTHER PUBLICATIONS

International Search Report for PCT/US2010/046160, dated Mar. 29, 2011, 3 pages.

(Continued)

*Primary Examiner* — Douglas W Owens
*Assistant Examiner* — Jianzi Chen
(74) *Attorney, Agent, or Firm* — Reising Ethington P.C.

(57) ABSTRACT

A crossed field device, such as a magnetron or crossed field amplifier, that includes a cathode, an anode, one or more magnetic elements, and one or more extraction elements. In one embodiment, the crossed field device includes an annular cathode and anode that are axially spaced from one another such that the device produces an axial electric (E) field and a radial magnetic (B) field. In another embodiment, the crossed field device includes an oval-shaped cathode and anode that are radially spaced from one another such that the device produces a radial electric (E) field and an axial magnetic (B) field. The crossed field device may produce electromagnetic (EM) emissions having a frequency ranging from megahertz (MHz) to terahertz (THz), and may be used in one of a number of different applications.

34 Claims, 11 Drawing Sheets

(56) References Cited

OTHER PUBLICATIONS

P.L. Kapitza, "The Prospects for the Future Development of High-Power Electronics," In: High-Power Microwave Electronics, Pergamon Press, The Macmillan Company, New York, 1964, pp. 106-114.
T.A. Spencer, "Current HPM Source Research," Proceedings of the 6th Workshop on High Energy Density and High Power RF, Berkeley Springs, West Virginia (USA): AIP, 2003, p. 46.
G.B. Collins, "Microwave Magnetrons", McGraw-Hill, New York, 1948 1 page.
R.M. Gilgenbach, Y.Y. Lau, H. McDowell, K.L. Cartwright, and T.A. Spencer, "Crossed-Field Devices", Chapter 6 in "Modern Microwave and Millimeter Wave Power Electronics", edited by R.J. Barker, N.C. Luhmann, J.H. Booske, and G.S. Nushinovich, IEEE Press, Piscataway, NJ 2004 (and references therein) 25 pages, 2013.
W.M. Black, R.K. Parker, R. Tobin, G. Farney, M. Herndon, V.L. Granatstein, "A Hybrid Inverted Coaxial Magnetron to Generate Gigawatt Levels of Pulsed Microwave Power", International Electron Devices Meeting, 1979, vol. 25, pp. 175-178.
R.K. Parker, R. Tobin, G.K Farney, "Initial Performance Characteristics of a High Power Hybrid Inverted Coaxial Magnetron:", 1980 International Conference on Plasma Science, p. 94 of proceedings.
W.M. Black, M Bollen, R. Tobin, R.K. Parker, L.R. Barnett, G. Farney "A High Power Magnetron for Air Breakdown Studies", International Electron Devices Meeting, 1980, vol. 26, pp. 180-183.
R.A. Close, A. Palevsky, G. Bekefi, Radiation Measurements from an Inverted Relativistic Magnetron, J. Appl. Phys. 54 (7), p. 4147, Jul. 1983.
M.C. Jones, V.B. Neculaes, Y.Y. Lau, R.M. Gilgenbach, and W.M. White, "Cathode Priming of a Relativistic Magnetron", Applied Physics Letters, vol. 85, p. 6332, Dec. 27, 2004.
B.W. Hoff, R.M. Gilgenbach, N.M. Jordan, Y.Y. Lau, E. Cruz, D. French, M.R. Gomez, J.C. Zier., T.A. Spencer, D. Price "Magnetic Priming at the Cathode of a Relativistic Magnetron" IEEE Trans. Plasma Science, Special Issue on HPM, vol. 36, No. 3, p. 710, Jun. 2008.
R.V. Harrowell, "A New, Radial B-field Magnetron for Use in Microwave Ovens," Journal of Physics D: Applied Physics, vol. 17, 1984, pp. L43-L46.
L. Ludeking G. Thomas, and W. Bollen, "Simulation and Analysis of a Reentrant Planar Magnetron," Proceedings of the 1987 International Electron Devices Meeting, 1987, pp. 160-163.
Jung-Il Kim, Seok-Gy Jeon, Yun-Sik Jin, Geun-Ju Kim, Dae-Ho Kim, and Sun-Shin Jung, "Particle-in-Cell Simulation of 100 GHz Reentrant Linear Magnetron," Infrared, Millimeter and Terahertz Waves, 2008. IRMMW-THz 2008. 33rd International Conference on, 2008, pp. 1-2.
J. Kim, S. Jeon, Y. Jin, G. Kim, D. Kim, and S. Jung, "Investigation of the 100 GHz Reentrant Linear Magnetron Using Particle-in-Cell Simulation," J. Vac. Sci. Technol. B, AVS, 2009, pp. 687-691.
Donald A. Shiffler, J. Luginsland, M. Ruebush, M. Lacour, K. Golby, K. Cartwright, M. Haworth, and T. Spencer. "Emission Uniformity and Shot-to-Shot Variation in Cold Field Emission Cathodes", IEEE Transactions on Plasma Science, Vol. 32, No. 3, p. 1261, Jun. 2004.
M.C. Jones, V.B. Neculaes, R.M. Gilgenbach, W.M. White, M.R. Lopez, Y.Y. Lau, T.A. Spencer, and D. Price, "Projection Ablation Lithography Cathode for High Current Relativistic Magnetron", Review of Scientific Instruments, vol. 75, p. 2976, Sep. 2004.
N.M Jordan, R.M. Gilgenbach, B.W. Hoff, and Y.Y. Lau, "Metal-OxideJjunction, Triple Point Cathodes in a Relativistic Magnetron", Rev. Sci. Inst. 79 064705 (2008) published online Jun. 11, 2008 1 page.
Y.Y. Lau, "A Collective Interaction Klystron," Phys. Rev. Lett. 53, 395-398 (1984); patented in U.S. Patent #4,617,493, Oct. 4, 1986.
D. Chernin and YY Lau, "Stability of Laminar Beams", Phys Fluids 27 2319 (1984).
B B Godfrey and T.P. Hughes, "Long Wavelength Negative Mass Instabilities in high current betatrons", Phys. Fluids, 28, 669 (1985) 8 pages.
Y.Y. Lau, "Theory of Crossed-Field Devices and a Comparative Study with Other Coherent Radiation Sources," Chapter 9 in "High Power Radiation Sources", Eds. I. Alexeff and V.L. Granatstein, Artech House, Norwood, MA (1987), p. 309.
Y.Y. Lau and D. Chernin, "Stabilization of the Negative Mass Instability in a Rotating Relativistic Electron Beam," Phys. Rev. Lett. 52, 1425-1428 (1984).
C.E. Nielson, A.M. Sessler, and K.R. Symon, in Proc. Int'l Conf. Accelerators, CERN, Geneva, (1959), 17 pages.
A.A. Kolomenskii and A.N. Lebedev, J. Nucl. Energy C3, 44 (1961), 5 pages.
Y.Y. Lau and D. Chernin, "A Review of AC Space Charge Effect in Electron Circuit Interactions," Phys. Fluids B4, 3473-3497 (1992).
Neil, Kevin V., and Sessler, Andrew M., Longitudinal Resistive Instabilities of Intense Coasting Beams in Particle Accelerators, The View of Scientific Instruments, vol. 36, No. 4, 8 pages, 2013.

* cited by examiner

CROSSED FIELD DEVICE

REFERENCE TO RELATED APPLICATIONS

This application claims the benefit of U.S. Provisional Ser. No. 61/235,812 filed Aug. 21, 2009, the entire contents of which are incorporated herein.

This invention was made with government support under Contract Nos. FA9550-05-1-0087 and FA9550-10-1-0104 awarded by The Air Force Office of Scientific Research. The government has certain rights in the invention.

TECHNICAL FIELD

This invention generally relates to devices that produce electromagnetic (EM) emissions and, more particularly, to crossed field devices that produce such emissions.

BACKGROUND OF THE INVENTION

Although crossed field devices, such as magnetrons and crossed field amplifiers, have been used in a variety of different applications ranging from microwave ovens to military radar equipment, certain technical challenges still exist.

For example, some crossed field devices are unable to produce high frequency electromagnetic (EM) emissions at elevated power levels. Generally, very small cathode and/or anode structures and features are needed in order to generate emissions having such small wavelengths. Such structures and features oftentimes cannot withstand the electrical current and resulting heat that is required to generate the power levels needed. These are only examples of some of the potential concerns and challenges that may need to be considered when designing a crossed field device, as many others certainly exist.

SUMMARY OF THE INVENTION

According to one aspect, there is provided a crossed field device for generating electromagnetic (EM) emissions. The crossed field device may comprise: a cathode, an anode that is axially spaced from the cathode and has a plurality of cavities, a magnetic element, and an extraction element that conveys the electromagnetic (EM) emissions from the crossed field device to an intended load. The crossed field device may be a recirculating device that creates an axial electric (E) field and a radial magnetic (B) field.

According to another aspect, there is provided a crossed field device for generating electromagnetic (EM) emissions. The crossed field device may comprise: a cathode, an anode that has a plurality of cavities where at least one of the cathode and/or the anode is generally oval-shaped, a magnetic element, and an extraction element that conveys the electromagnetic (EM) emissions from the crossed field device to an intended load. The crossed field device may be a recirculating device that creates a radial electric (E) field and an axial magnetic (B) field.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Crossed field devices, such as magnetrons and crossed field amplifiers, use electrons in electric and magnetic fields to generate electromagnetic (EM) emissions and may be employed in a number of different applications. For example, crossed field devices may be used in microwave ovens, radar systems, medical equipment, scientific instruments, communication systems, electronic counter measures, and certain lighting arrangements, to name a few examples. Although the following description is provided in the context of an exemplary magnetron, it should be appreciated that it also applies to other crossed field devices like crossed field amplifiers.

The term "planar," as used herein in the context of an anode, cathode or other element of a crossed field device, broadly refers to a component having a thickness in the axial direction that is less than or equal to one wavelength (λ) of the electromagnetic (EM) emissions produced by the crossed field device. It should be appreciated that "planar" does not require a component to be perfectly flat or perfectly planar, only that it be generally or substantially planar, like the devices taught herein. The term "oval" or "oval-shaped," as used herein in the context of an anode, cathode or other element of a crossed field device, broadly refers to a component having a shape that includes at least one straightaway segment and at least one curved segment. It should be appreciated that "oval" or "oval-shaped" does not require a component to be perfectly oval shaped, only that it be generally or substantially oval, oblong, elliptical, eyeglass, etc. in shape, like the devices taught herein.

Crossed Field Device with Axial Electric Field and Radial Magnetic Field

Figure 1:
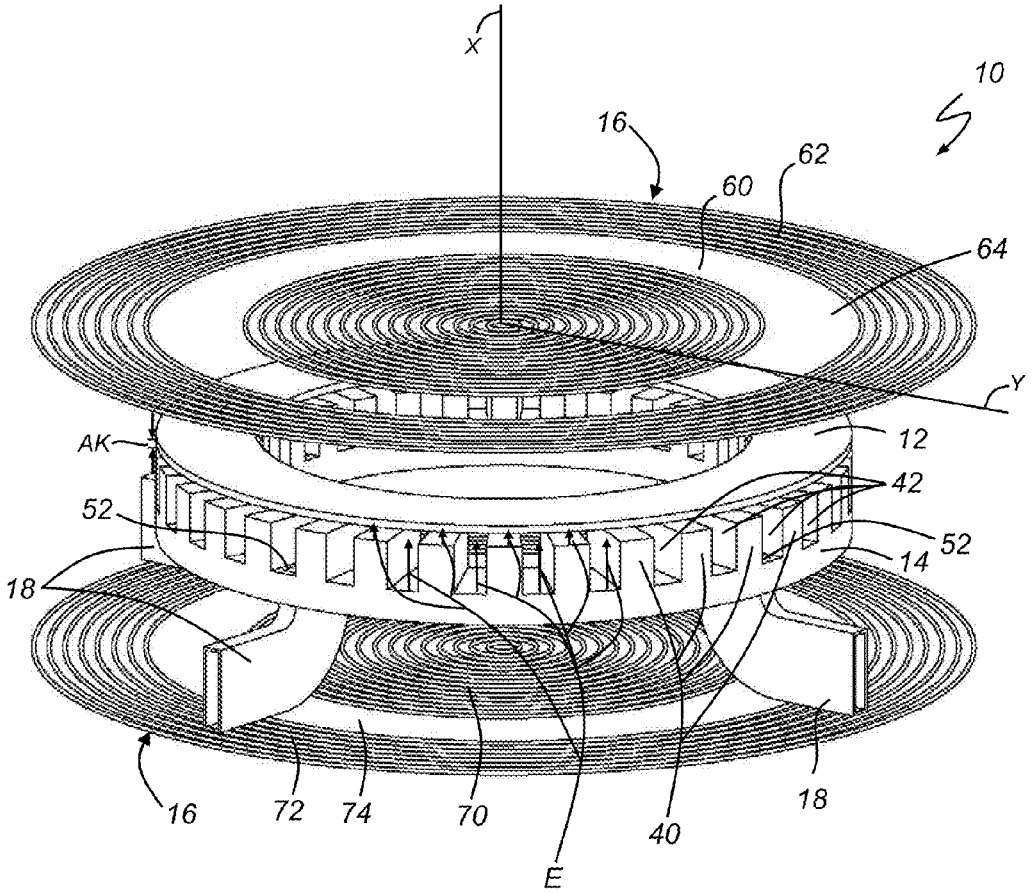
FIG. 1 is a perspective view of an exemplary embodiment of a crossed field device.
Figure 2:
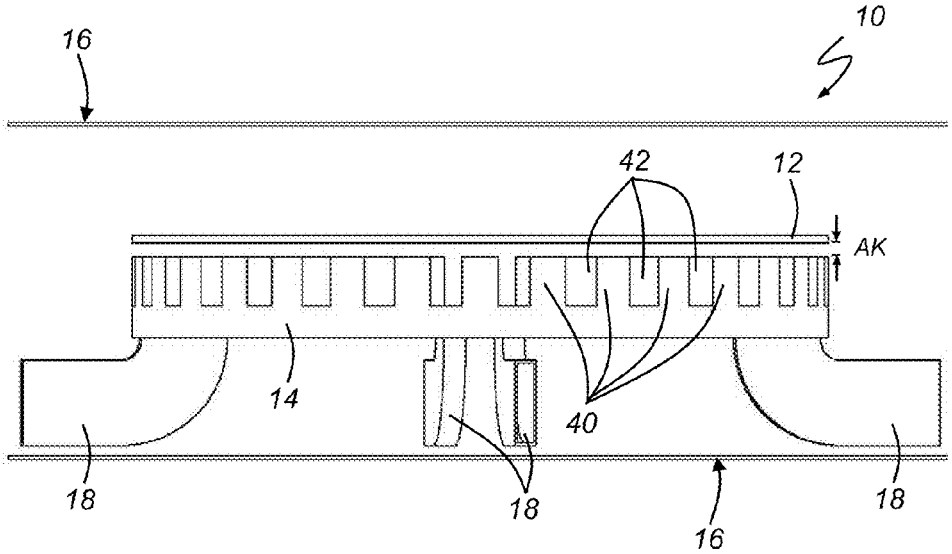
FIG. 2 is a side view of the crossed field device of FIG. 1.

With reference to FIGS. 1 and 2, there is shown an exemplary embodiment of a recirculating crossed field device 10 that includes a cathode 12, an anode 14, several magnetic elements 16, and several extraction elements 18. Generally speaking, an electric (E) field is established between anode 14 and cathode 12 that encourages electrons to flow from the cathode to the anode. At the same time, a magnetic (B) field is established that is perpendicular to the electric field and exerts a force on the electrons that opposes that of the electric field. In the presence of these two fields, electrons are emitted from cathode 12, begin to travel towards anode 14 under the force of the electric field, but are turned away from the anode due to the magnetic field. The electrons begin to spiral around crossed field device 10, and in the process they flow in and out of a series of cavities in anode 14 and interact with resonant electromagnetic (EM) fields that cause corresponding EM emissions. These emissions, which may have a frequency ranging from megahertz (MHz) to terahertz (THz), are then extracted by extraction elements 18 and are directed or channeled to an intended load, such as a cooking chamber (microwave ovens) or a high gain antenna (radar equipment). It should be appreciated that crossed field device 10 may be used as an oscillator where radiation is extracted from the device, as an amplifier where an input signal is provided to the device and an amplified signal is extracted from the device, or as some other suitable application. Crossed field device 10, cathode 12 and/or anode 14 may be annular or ring-shaped, as shown in FIGS. 1-10, or they may be disk-shaped (as opposed to annular), concave or convex (as opposed to flat), or oval, tri-oval, quad-oval or oblong (as opposed to circular), to cite a few possibilities.

Cathode 12 acts as an electrode in crossed field device 10, and is typically provided with a negative voltage (relative to anode 14) so that it emits electrons therefrom. According to the exemplary embodiment shown here, cathode 12 is a generally annular component that emits electrons from an axial end that faces an anode-cathode (AK) gap which separates the cathode from the anode. In the particular embodiment shown in FIGS. 1-2, cathode 12 is designed to oppose anode 14, which is also generally annular, across the AK gap. It should be appreciated that cathode 12 is only exemplary and may be provided with many other features, characteristics, embodiments, arrangements, etc. For example, cathode 12 may include resonant cavities, slots, grooves, channels, meander lines, folded waveguides, or other features for influencing or channeling electromagnetic (EM) emissions or electron orbits; or it may be a thermionic cathode (e.g., oxide or dispenser cathode), field emission cathode (e.g., carbon fiber or nanotube), secondary electron emission cathode, Spindt-type cathode, Shiffler-type cathode (e.g., cesium-iodide processed on carbon fibers), laser micro-machined cathode, metal dielectric triple point cathode, etc., to cite a few possibilities. In addition, cathode 12 may include emitting and non-emitting regions, and be made of different materials and geometries.

Figure 3:
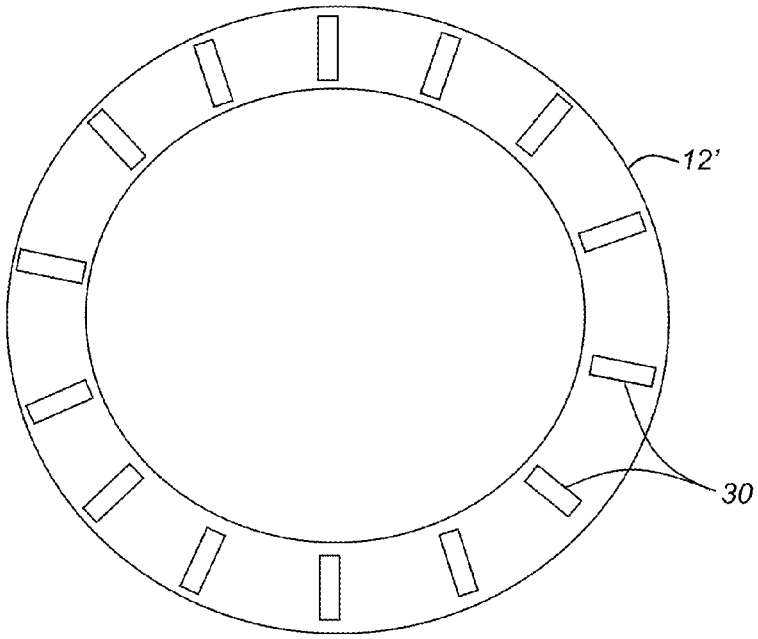
FIG. 3 is a top view of an exemplary cathode that may be used with the crossed field device of FIG. 1.
Figure 4:
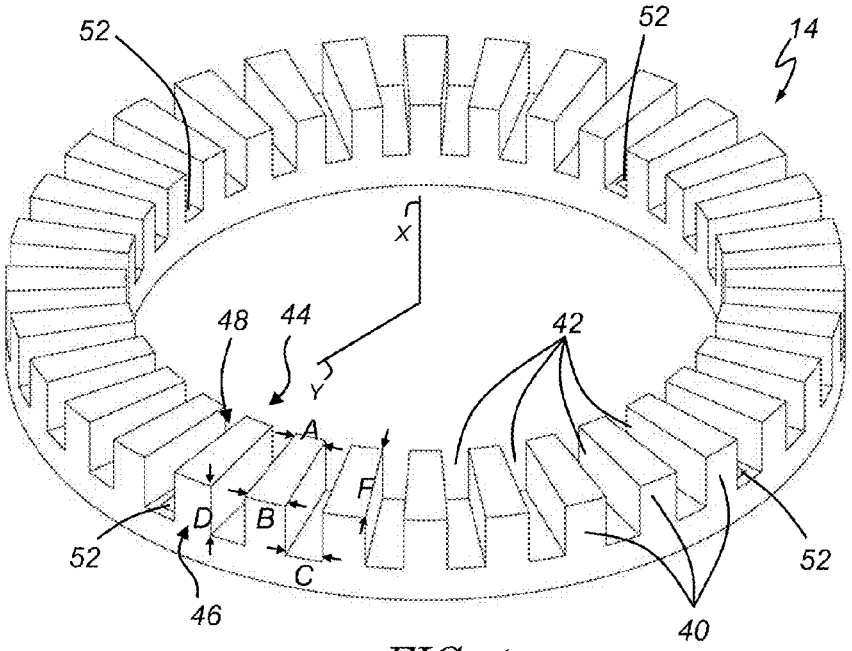
FIG. 4 is a perspective view of an exemplary anode that may be used with the crossed field device of FIG. 1.

In another embodiment shown in FIG. 3, the cathode 12' is a flat annular component, but includes a number of electron emission elements 30 for promoting π-mode operation; also referred to as π-mode cathode priming. The electron emission elements 30 shown here are elongated rectangular elements that are located on the axial end of the cathode facing the AK gap, and generally extend along cathode 12' in a radial manner. These electron emission elements 30 are designed to emit or provide electrons from cathode 12' in a manner that causes the electrons to bunch together such that they form certain spoke patterns; put differently, the electron emission elements can affect the flow of electrons so that they promote desired electromagnetic (EM) emissions. The π-mode and other modes of operation will be subsequently described in greater detail. It should be appreciated that electron emission elements 30 may be provided in any shape, size and/or configuration, including ones that differ from the exemplary shown here.

Anode 14 also acts as an electrode in crossed field device 10, and is typically provided with a positive voltage (relative to cathode 12) so that it can attract the electrons emitted from the cathode. In the exemplary embodiment shown in FIGS. 1-2 and 4, anode 14 is axially spaced from cathode 12, is a generally annular component, and includes a series of projections 40 and cavities 42 formed on an axial end that faces the AK gap. Projections 40 are shown here as a succession of teeth or vanes that extend around the circumference of anode 14 and are interspaced with or are separated from one another by cavities 42. According to this particular embodiment, each projection 40 is tapered somewhat in the radial direction to have a narrower width A at an inner radial end 44 and a wider width B at an outer radial end 46; this tapered configuration results in adjacent cavities 42 having a more uniform width C. In other embodiments, the projections may be uniform in width and the cavities may be tapered or both the projections and the cavities may be tapered somewhat, to cite a few possibilities. Each of the preceding projection/cavity embodiments can have certain attributes and the selection of one embodiment over another may be driven by the particular application in which the anode is used. For instance, a more uniform cavity width C may promote better electromagnetic (EM) emissions, while a more uniform projection width A/B may be better suited for manufacturing.

The size, shape, location, orientation and/or number of projections 40 and/or cavities 42 may impact the resonant electromagnetic (EM) fields that form in the cavities and thus the resultant EM emissions. For example, if crossed field device 10 is designed to generate EM emissions having a frequency in the terahertz (THz) range, then cavities 42 may be rectangular in shape and may need to have an axial depth (D) that is less than or equal to a millimeter (mm) in order to promote the resonant EM fields needed for this frequency. There are a number of different techniques for determining cavity size, any one of which may be used here. For example, empirical data has shown that it may be desirable for: the axial depth (D) of the cavity to be $\lambda/4$ (where $\lambda$ is the wavelength of the desired EM emissions); the circumferential width of the cavity (C) to be determined by matching the crossed electric and magnetic fields (ExB) velocity with the phase velocity of the device (e.g., using the Buneman-Hartree resonance); and the radial length (F) of the cavity to be multiples of $\lambda/2$. Of course, the foregoing sizes, relationships and techniques for determining cavity size and shape are only exemplary, as others could be used instead.

Figure 5:
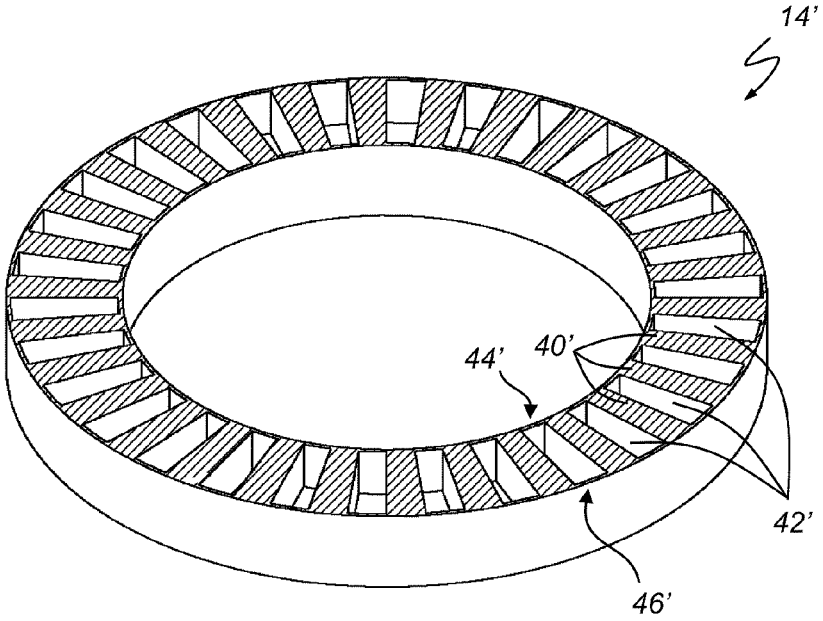
FIG. 5 is a perspective view of another exemplary anode that may be used with the crossed field device of FIG. 1, where the anode shown here is closed at inner and outer radial ends.

Each of the exemplary cavities 42 is open at an upper axial end 48 that faces cathode 12 across the AK gap, as well as at inner and outer radial ends 44 and 46; this enables electrons to flow in and out of the cavities during operation, as will be described. It should be appreciated that projections 40 and cavities 42 are only exemplary, and that projections and cavities having other shapes, sizes, orientations, etc. could be used instead. For example, FIG. 5 shows another possible arrangement for an anode 14', where cavities 42' are closed off or sealed on both their inner and outer radial ends 44' and 46'. The circumferential walls used to close off cavities 42' may be integrally formed with projections 40' or they may simply be thin ring-shaped components that are welded or otherwise attached to the inner and outer circumferential perimeters of anode 14'. Closing off the inner and/or outer radial ends of cavities 42' can prevent electromagnetic (EM) emissions from leaking out of these cavities, and can manipulate or otherwise affect the electron flow and improve the quality or 'Q' factor of the device (relates to the storage of electromagnetic energy in the structure which promotes oscillation). Of course, other modifications to the anode are also envisioned. In one instance, a 'rising sun' type configuration is used where the projections and cavities are not all uniform in size and shape; if suitably designed, this type of configuration may reduce undesired or non-dominant modes. In another embodiment, adjacent projections 40 may be joined or combined together so that one large projection is created and the intervening cavity 42 is removed. A large projection like this creates a longer circumferential extent where there are no cavities; such a non-cavity length could be used to accelerate the electrons as they flow around crossed field device 10, for example.

Anode 14 may be manufactured using any suitable technique or process including, but certainly not limited to, casting, stamping, machining, sintering, electrical discharge machining (EDM), ion etching, laser micro-machining, LIGA microfabrication, deep reactive-ion etching (DRIE), other semiconductor fabrication techniques, and more. In addition, it is possible for projections 40 to be separately manufactured from the rest of anode 14 and then attached to the anode by way of welding, brazing, soldering, etc. It should be appreciated that anode 14 is only exemplary and may be provided with many other features, characteristics, embodiments, arrangements, etc. For example, anode 14 may include folded waveguides, slots, grooves, channels, or other features for influencing or channeling EM emissions; or it may have cavities and/or projections that vary from those shown here in terms of size, shape, orientation, etc., to cite a few possibilities.

Magnetic elements 16 generate a magnetic B field, which is crossed with the electric E field that is established between cathode 12 and anode 14. According to an exemplary embodiment, magnetic elements 16 include several sets of magnetic coils and may create a DC or pulsed magnetic B field. A first or upper set of coils is located above cathode 12 and includes a disk-shaped coil 60 that is coaxial with the cathode/anode and has an outer diameter comparable to the inner diameter of the cathode, and a ring-shaped coil 62 that is coaxial with the cathode/anode and has an inner diameter comparable to the outer diameter of the cathode. Coils 60 and 62 are axially outboard of cathode 12; that is, they are located further away, in the axial direction, from the rest of the crossed field device than is the cathode. This arrangement produces an annular gap 64 positioned between coils 60 and 62. A second or lower set of coils is located below anode 14 and includes a disk-shaped coil 70 that is coaxial with the cathode/anode and has an outer diameter comparable to the inner diameter of the anode, and a ring-shaped coil 72 that is coaxial with the cathode/anode and has an inner diameter comparable to the outer diameter of the anode. Coils 70 and 72 are axially outboard of anode 14; that is, they are located further away, in the axial direction, from the rest of the crossed field device than is the anode. As with the upper set of coils, the lower set of coils produces an annular gap 74. The strength, direction and/or other parameters of the magnetic field may be manipulated by changing the size, location, spacing, etc. of coils 60, 62, 70, 72 and/or annular gaps 64, 74. Of course, the particular magnetic element arrangement shown here is only one possibility, as any magnetic element configuration capable of producing a suitable magnetic field may be used instead. This includes other magnetic coil arrangements, as well as permanent magnets and pole pieces.

Extraction elements 18 channel, guide, direct and/or conduct electromagnetic (EM) emissions from crossed field device 10 to a desired load, and may be provided in a number of different forms and embodiments. For instance, extraction elements 18 may include one or more waveguides or other structures that are coupled at one end to cavity 42 and at another end to a desired load, such as a cooking chamber (microwave ovens) or a high gain antenna (radar equipment). Electromagnetic (EM) emissions that are produced in cavity 42 can then be transmitted or guided to the desired load. Skilled artisans will appreciate that the size and shape of extraction element 18 may be matched to the wavelength and/or other characteristics of the electromagnetic (EM) emissions being channeled. In an exemplary embodiment, crossed field device 10 includes several rectangular cross-sectioned extraction elements or waveguides 18, where each waveguide is coupled to a communicating cavity (i.e., a cavity 42 that communicates with an extraction element) through an opening 52 in the axial end of the anode that is spaced away from the AK gap (i.e., the axial end opposite axial end 48). Each communicating cavity may be located next to one or more non-communicating cavities (instead of having a number of communicating cavities in a row), and the communicating cavities may promote pi-mode operation in the crossed field device, to cite two possibilities. Each of these exemplary waveguides may direct or guide electromagnetic (EM) emissions out of the crossed field device in a generally axial manner; this can be particularly desirable in high frequency applications. Preferably, the communicating cavities are cavities that house strong resonant electromagnetic (EM) fields. In an amplifier configuration, it is possible for one of the waveguides to be an input device and one of the waveguides or extraction elements 18 to be an output device; thus, a signal is inputted or provided to crossed field device 10, it propagates around the device such that it is amplified, and the amplified version of the signal is outputted via an extraction element 18. In such an arrangement, it may be desirable to circumferentially space the output waveguide as far as possible from the input waveguide so that a maximum amount of signal amplification may occur.

Figure 7:
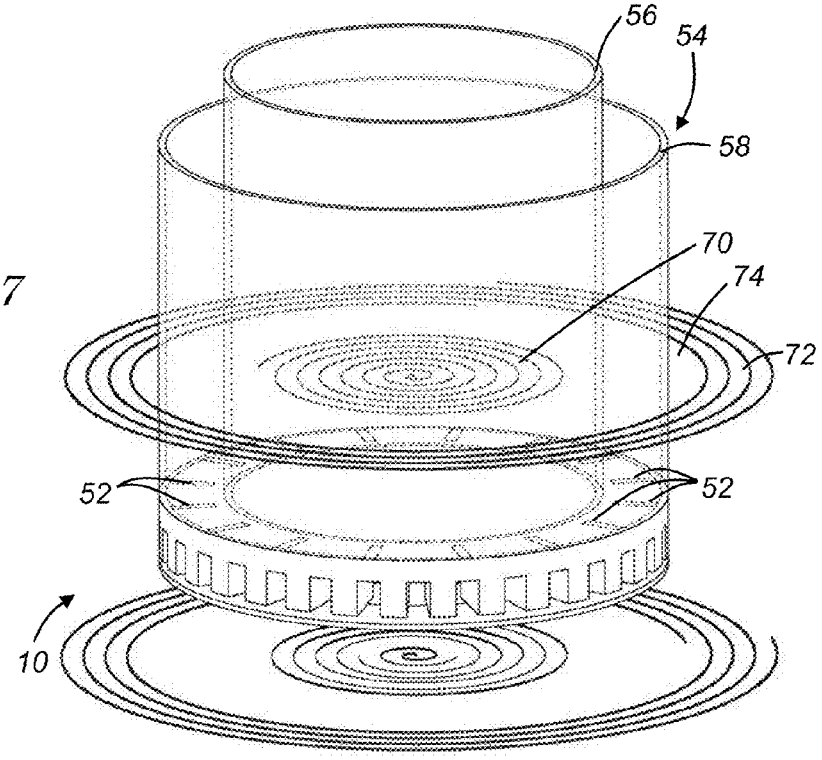
FIG. 7 is a perspective view of another extraction element that may be used with the crossed field device of FIG. 1, where the extraction element includes a cylindrical sleeve coupled to an axial end of the anode.
Figure 8:
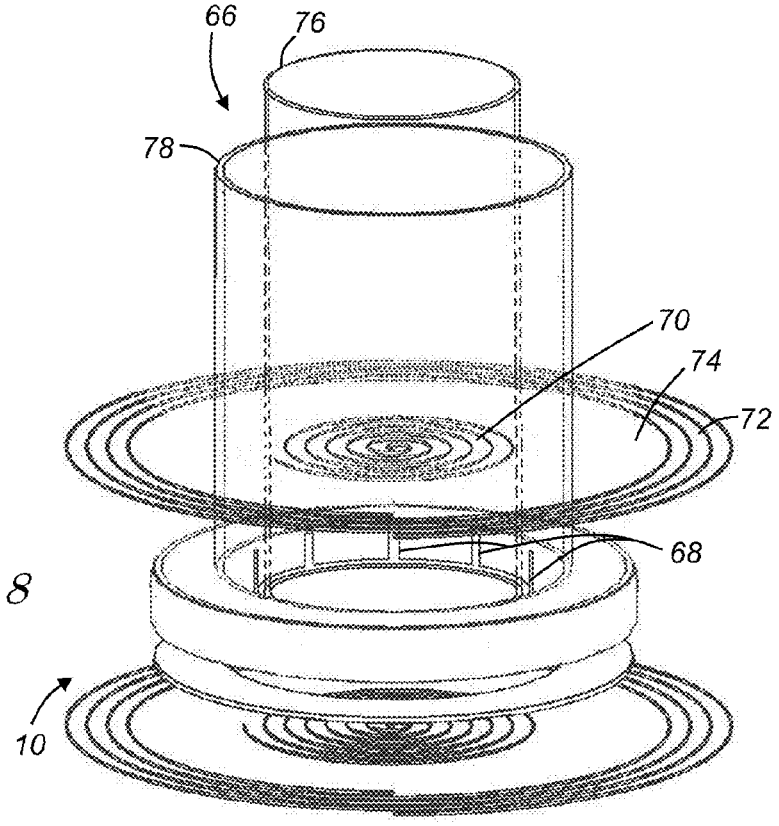
FIG. 8 is a perspective view of another extraction element that may be used with the crossed field device of FIG. 1, where the extraction element includes a cylindrical sleeve coupled to an inner radial end of the anode.
Figure 9:
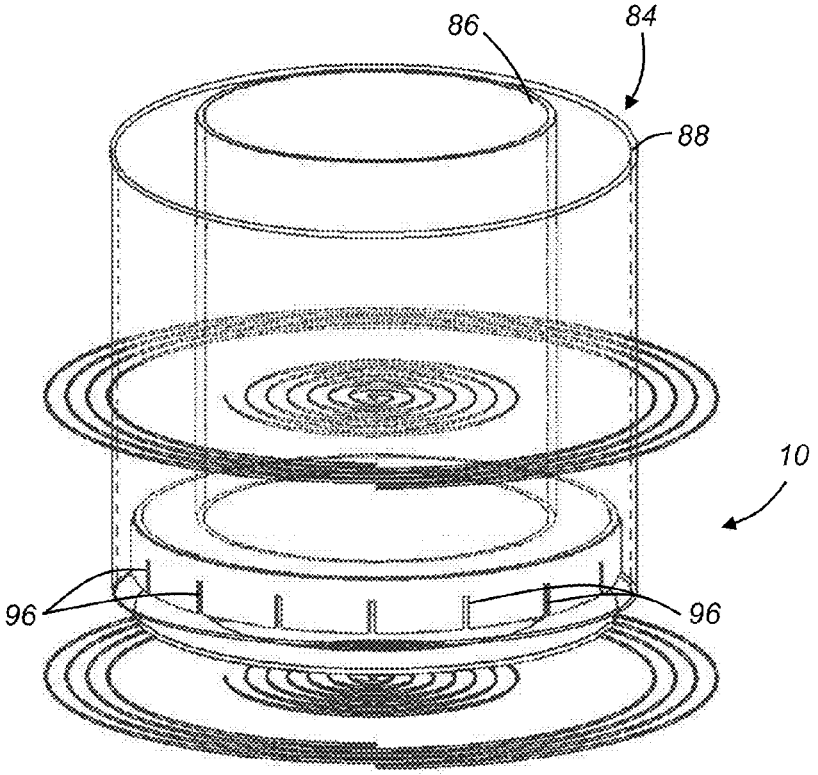
FIG. 9 is a perspective view of another extraction element that may be used with the crossed field device of FIG. 1, where the extraction element includes a cylindrical sleeve coupled to an outer radial end of the anode.

Several different extraction element embodiments are shown in FIGS. 7-9, however, these are not the only types of extraction elements that may be used with crossed field device 10. In FIG. 7, crossed field device 10 includes a different extraction element 54 that is generally in the shape of a cylindrical sleeve and is coupled to a number of communicating cavities in the anode through openings 52. The orientation of FIG. 7 has been flipped, with respect to that of FIG. 1, in order to better illustrate this feature. In this particular embodiment, extraction element 54 includes inner and outer sleeve walls 56, 58 that define a tube-like space or volume therebetween and pass through the annular gap 74 formed between magnetic coils 70 and 72. It is through this tube-like space that electromagnetic (EM) emissions may be guided or channeled out of crossed field device 10 in a generally axial manner. Skilled artisans will appreciate that at higher frequencies waveguides may not be the most preferred extraction element due to issues such as losses and power handling; thus, the potential use of other extraction elements such as that shown in FIG. 7. As with the exemplary embodiment described earlier, each communicating cavity may be located next to one or more non-communicating cavities (instead of having a number of communicating cavities in a row), and the communicating cavities may promote pi-mode operation in the crossed field device.

In FIG. 8, there is another embodiment of a potential extraction element 66 that may be used with crossed field device 10. In this particular embodiment, extraction element 66 is in the shape of a cylindrical sleeve with inner and outer sleeve walls 76, 78, and is coupled to a number of communicating cavities in the anode through openings 68. These openings are shown in the form of thin axially-aligned slits on the inner radial end 44 of the anode, as opposed to being on an axial end of the anode as in the embodiment of FIG. 7. Because of their position and orientation, openings 68 are able to guide or channel electromagnetic (EM) emissions out of the crossed field device 10. Again, extraction element 66 may pass through the annular gap 74 that is formed between magnetic coils 70 and 72, although other arrangements are possible. FIG. 9 shows another extraction element embodiment, only this time extraction element 84 is a cylindrical sleeve with inner and outer sleeve walls 86, 88, but is coupled to various communicating cavities in the anode through openings 96 which are on the outer radial end 46 of the anode. Openings 96 are in the form of thin axially-aligned slits, but could certainly take some other form instead. Electromagnetic (EM) emissions may escape from one or more cavities in the anode of crossed field device 10, pass through openings 96, and be guided or channeled by extraction element 84 to a desired load.

Figure 6:
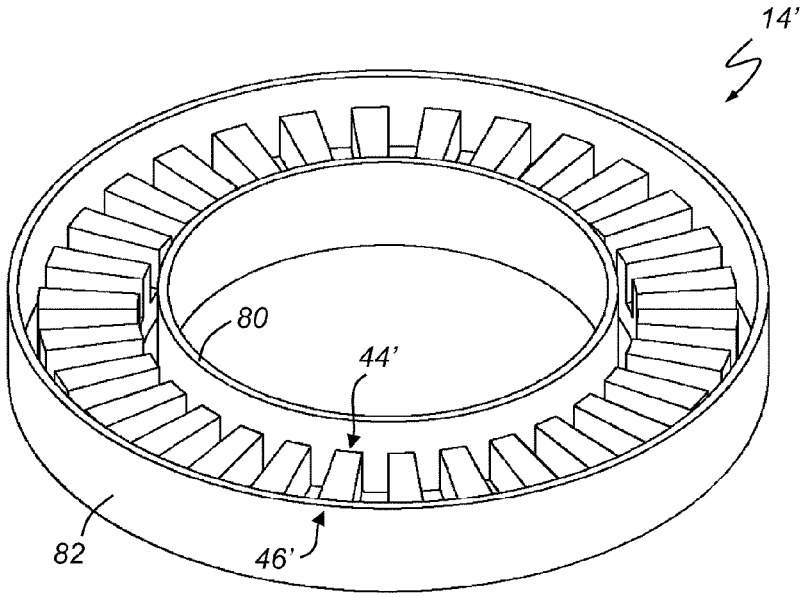
FIG. 6 is a perspective view of another exemplary anode that may be used with the crossed field device of FIG. 1, where the anode shown here includes electrically-insulated electron reflectors.

It should be appreciated that the different extraction element embodiments 18, 54, 66 and 84 are only exemplary and that other features, characteristics, embodiments, arrangements, etc. may be used instead. For example, extraction elements may include quasi-optical output couplers, folded waveguides, dielectric output couplers, diffraction gaps, ridged waveguides, bowtie waveguides, C- or H-shaped cavities, tapered vanes or projections, coupling loops, photonic bandgap structures, inductive coupling, capacitive coupling, and coaxial transmission lines, to name a few possibilities. The extraction elements may have a variety of different shapes and, in one specific embodiment, could even be parabolic in nature. The extraction elements may be arranged to extract or guide electromagnetic (EM) emissions (including EM electric field or EM magnetic field) from the crossed field device in a generally radial manner, a generally axial manner or according to some other orientation. In one potential arrangement, extraction element 18 includes one or more coaxial transmission lines that are electrically connected to one or more projections 40 of the anode or to some other component of the crossed field device, including components of the anode, cathode, strapping member, etc. Other arrangements are possible as well. It should be appreciated that any number of additional elements, components, features, arrangements, etc. may be used with crossed field device 10. For instance, FIG. 6 shows an anode 14' with several negatively-biased electron reflectors 80, 82 that extend near the inner and outer radial ends 44', 46' of the anode, respectively, and encourage the electrons to stay within the AK gap located between cathode 12 and anode 14. In this particular embodiment, electron reflectors 80, 82 are thin ring-shaped components that have an axial width that is comparable to that of the anode, and are electrically-insulated from the anode. Electron reflectors having different shapes, sizes, locations, and configuration may also be used. Another feature that may be used is a strap that circumferentially extends around anode 14 and couples together certain cavities in an effort to promote desired modes (e.g., $\pi$-mode) and discourage undesired modes. This technique is sometimes referred to as 'strapping'. Additional slots, openings, passageways, diffraction elements, reflectors, etc. may also be used with crossed field device 10 for purposes of channeling or guiding electromagnetic (EM) emissions. For instance, a slot can be formed between two different cavities so that electromagnetic (EM) emissions are allowed to leak from one cavity to another, thus, providing a form of feedback for crossed field device 10. Additional magnetic elements, as well as priming techniques, may be used; this includes magnetic priming, cathode priming, and anode priming, for example. Additional cavities and alternative cavity formations in the cathode, anode and/or electron reflectors may also be employed. Any number of other elements, components, features, arrangements, etc. may be used in addition to or in lieu of those mentioned above. In particular, an input waveguide and a separate output waveguide can be utilized for an amplifier.

Once assembled, the recirculating crossed field device 10 may be a generally flat or planar device and, according to the embodiment shown in the drawings, somewhat resembles a hockey puck or the like. Referring back to the exemplary embodiment of FIG. 1, it can be seen that crossed field device 10 has an overall diameter that is greater in length than its overall axial extent. The shape and overall configuration of crossed field device 10—and particularly cathode 12—may significantly differ from that of certain conventional crossed field devices, such as magnetrons typically found in microwave ovens. In those designs, the cathode is generally cylindrical in shape and has a size that can be limited by its small radius. Thus, crossed field device 10 may be referred to as a flat or planar device. Some potential advantages that may be enjoyed by exemplary crossed field device 10, include: reduced arcing and breakdown between the cathode and anode; increased cathode surface area for electron emission, thus reduced cathode loading and greater cathode current; improved manufacturability; improved heat dissipation and thermal management; increased design flexibility through a decoupling of the AK gap size, anode/cathode size, cavity size, number of cavities, etc.; and better efficiency by recirculating the electrons around the device (as opposed to non-recirculating linear devices). Of course, the preceding advantages are only some of the potential advantages that may be enjoyed by a crossed field device designed according to the teachings herein; they are not required and other advantages may be enjoyed as well.

Figure 10:
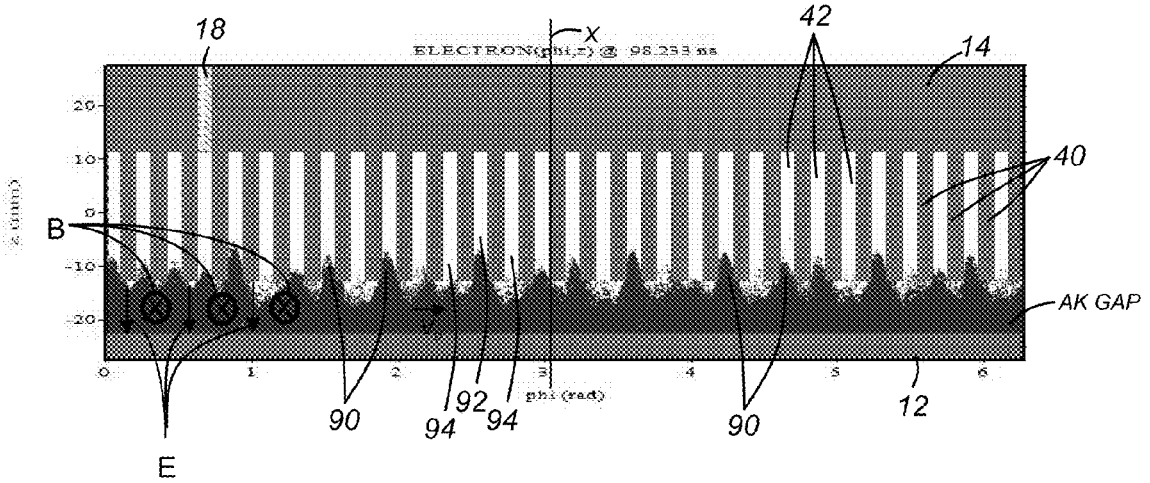
FIG. 10 is an illustration of the crossed field device in FIG. 1 during operation, where the device has been straightened out into a linear form for purposes of illustration.

During operation, a DC power source may be connected to cathode 12 and/or anode 14 so that an electric E field is established therebetween. The cathode and/or anode may be provided with a constant voltage, a pulsed voltage, or some other voltage in order to establish an axial electric field. An "axial electric field" broadly refers to electric fields that are generally aligned in the axial direction of the crossed field device, and does not require that the electric field be perfectly aligned along such axis. At the same time as the electric field, magnetic coils 60, 62, 70, 72 are supplied with an electric current and produce a radial magnetic field. A "radial magnetic field" broadly refers to magnetic fields that are generally aligned in the radial direction of the crossed field device, and does not require that the magnetic field be perfectly aligned in such a way. FIG. 10 is a side view of a simulated operation of crossed field device 10, where the circumferential AK gap that exists between cathode 12 and anode 14 has been straightened out and made linear for purposes of illustration. An exemplary axial DC electric field (E field) is illustrated, as well as an exemplary radial DC magnetic field (B field). Accordingly, the electric and magnetic fields oppose one another, with the DC electric field pushing the electrons from the cathode to the anode and the DC magnetic field preventing the electrons from actually reaching the anode.

The crossed DC electric and magnetic fields (ExB) cause electrons to spiral between the cathode and anode (so-called 'cycloidal flow') as they revolve around the crossed field device in the AK gap that separates the cathode from the anode (so-called 'recirculating flow' or electron drift). Generally, the cycloidal flow refers to the micro-flow path of a single electron, while the recirculating flow refers to the macro-flow path of a large number of electrons as they circulate around crossed field device 10; this phenomenon is sometimes called the 'Brillouin flow' and is designated by the symbol $v_0$. As the electrons begin to flow around crossed field device 10 in the AK gap, they move past cavities 42 and contribute energy to resonant electromagnetic (EM) fields formed therein. When put together, these various factors (electric field from anode/cathode, magnetic field from magnetic elements, and resonant electromagnetic (EM) fields in the cavities) act upon the electrons and cause them to bunch together and begin to form spokes or fingers 90. For a more complete description of this interaction, please refer to *Modern Microwave and Millimeter-Wave Power Electronics*, edited by Robert J. Barker et al., IEEE Press © 2005, Chapter 6: Crossed-Field Devices. This phenomenon is generally illustrated in FIG. 6.27.

As the electron spokes 90 circulate around crossed field device 10 in the AK gap, they interact with the resonant electromagnetic (EM) fields that have formed in cavities 42. This interaction may involve the transfer of energy between the recirculating electrons and the electromagnetic (EM) fields; in some cases, the electrons are providing energy to the EM fields and in some cases the EM fields are providing energy to the electrons. This interaction is further influenced by electromagnetic (EM) waves that circumferentially travel around and on the surface of anode 14, but do so along a longer path that includes flowing in and out of projections 40 as opposed to simply traveling in a purely circumferential path. Because these electromagnetic (EM) waves must traverse a longer path around the surface of anode 14, their overall rotational or circulative velocity is slowed down. Such devices are sometimes referred to as "slow wave structures" (SWS). According to an exemplary embodiment, crossed field device 10 is designed to operate in a π-mode where the phase of the resonant electromagnetic (EM) fields changes by π every successive cavity. Thus, an anode cavity 92 would have an electromagnetic (EM) field that is opposite in direction to the EM fields that are established in the adjacent anode cavities 94. Generally speaking, as the electron spokes 90 develop and become more pronounced and defined, the number of spokes equals the number of EM field phase changes (units of 2π phase changes) in all cavities 42. Consider an example where an anode has thirty cavities located around its circumference; in such a case, there are fifteen EM field phase changes and thus fifteen electron spokes 90. Typically, the π-mode is the desirable or dominant mode, but it may not be the only mode. Other non-dominant modes may exist, like a ⅔π-mode where the EM field phase shift between successive cavities is ⅔π. In the ⅔π-mode, a complete EM field phase shift occurs every three cavities, as opposed to every two cavities as in the π-mode; thus, in the example of thirty cavities, there would be ten complete EM field phase changes and thus ten electron spokes 90. Crossed field device 10 can also operate with traveling waves (either forward or backward) as an amplifier. Skilled artisans will appreciate that numerous techniques exist for reducing competition between the different modes, including the strapping and other examples provided above. Any suitable technique for reducing or otherwise manipulating mode competition may be employed with crossed field device 10.

When electron spokes 90 mature and become sufficiently interactive with cavities 42, the resonant electromagnetic (EM) fields produce or emit electromagnetic (EM) emissions in the form of radiation, signals, etc. As previously mentioned, the characteristics of these electromagnetic (EM) emissions may be driven by the shape, size and/or construction of cavities 42 and may have a frequency ranging from megahertz (MHz) to terahertz (THz), for example. In one embodiment crossed field device produces electromagnetic (EM) emissions in the range of 500 MHz-2 THz. Extraction element 18 then extracts or guides the electromagnetic (EM) emission through openings 52 in the communicating cavities and directs it to a desired load, like a cooking chamber in a microwave oven or a high gain antenna in a radar system. It should be appreciated that crossed field device 10 could be operated according to forward or backward traveling wave operation; it could be used as part of an amplifier or an oscillator; it could utilize periodic or alternating DC electric and/or DC magnetic fields; and it could engage in electric and/or magnetic field shaping, tapering, etc., to cite several possibilities. It is also possible for the crossed field device to include a second anode located on the other side of the cathode so that the device becomes a double-sided crossed field device. Many of the teachings from above would apply to such an embodiment.

Crossed Field Device with Radial Electric Field and Axial Magnetic Field

Figure 11:
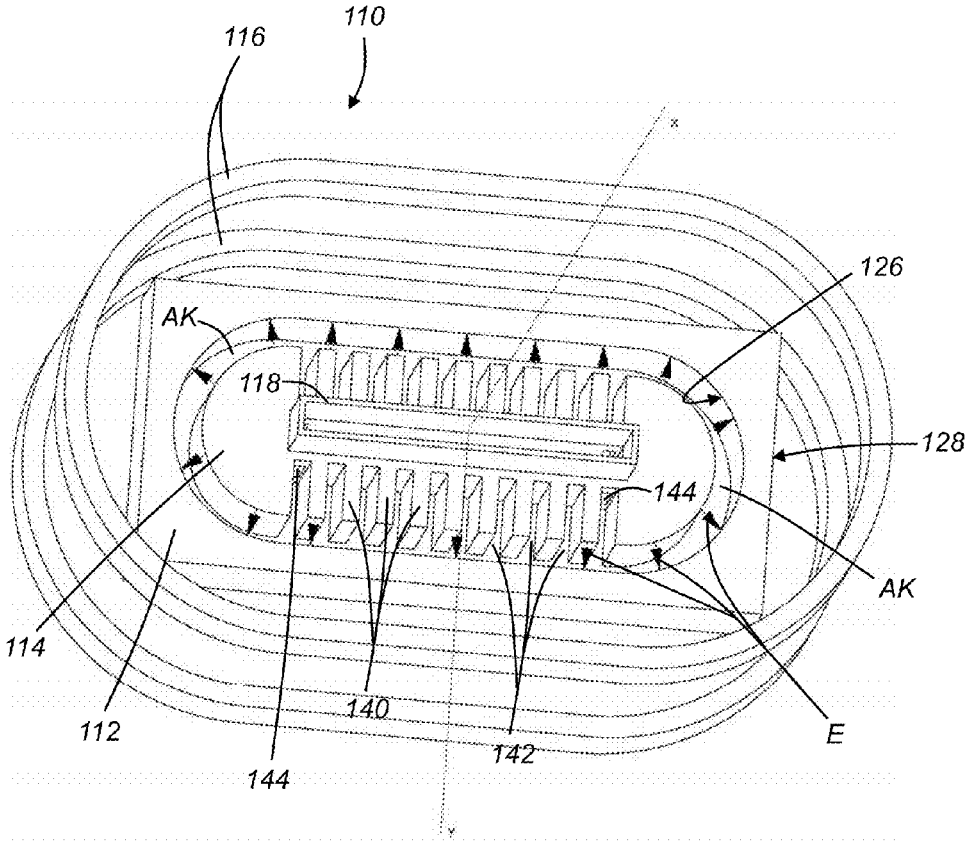
FIG. 11 is a perspective view of another exemplary embodiment of a crossed field device.
Figure 12:
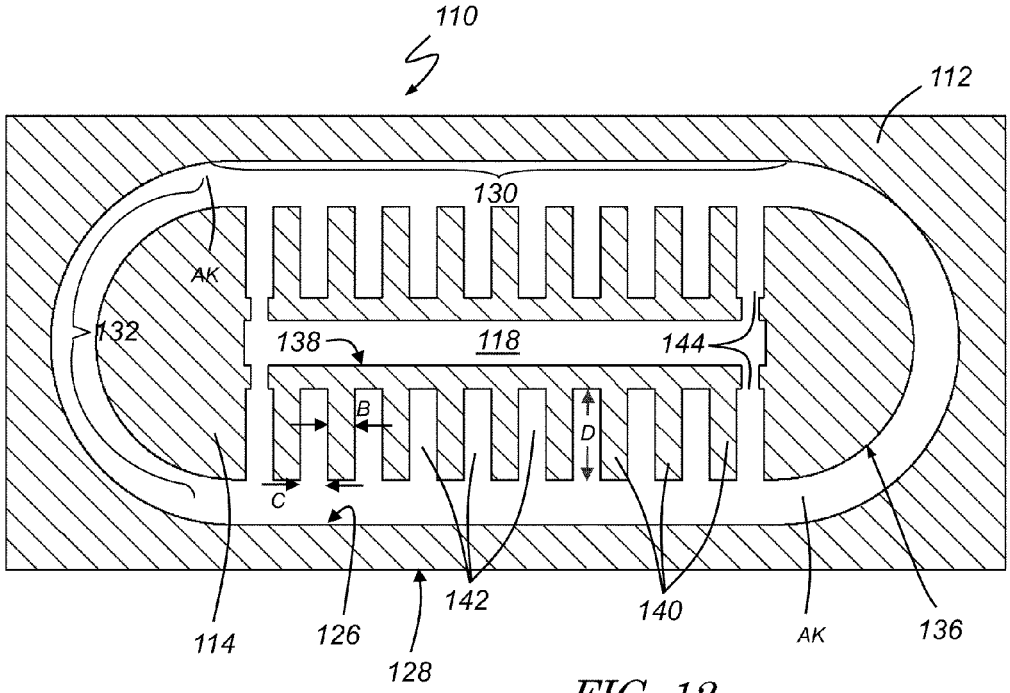
FIG. 12 is a sectional view of the crossed field device of FIG. 11.

Turning now to FIGS. 11 and 12, there is shown another exemplary embodiment of a recirculating crossed field device 110 that includes a cathode 112, an anode 114, several magnetic elements 116, and an extraction element 118. According to this particular embodiment, a radial electric E field is established between the cathode and anode while an axial magnetic B field is established by the magnetic elements. Thus, the electric and magnetic field orientations of this embodiment differ from those of the previous embodiment where the electric field was axially aligned and the magnetic field was radially aligned. A "radial electric field" broadly refers to electric fields that are generally aligned in the radial direction of the crossed field device, and does not require that the electric field be perfectly aligned in such a way. An "axial magnetic field" broadly refers to magnetic fields that are generally aligned in the axial direction of the crossed field device, and does not require that the magnetic field be perfectly aligned along the axis of the device. It should be appreciated that crossed field devices 10 and 110 are both "planar" and may share some of the same attributes, features, components, functionality, etc. Thus, a duplicate description is not always provided here, as portions of the description above for device 10 may be applicable to device 110 as well.

Cathode 112 acts as an electrode in crossed field device 110, and is typically provided with a negative voltage (relative to anode 114) so that it emits electrons therefrom. According to the exemplary embodiment shown here, cathode 112 is a generally planar or flat component that emits electrons from an oval-shaped inner end or surface 126 that faces anode 114 across the AK gap. Cathode 112 may include an inner end 126 that is oval-shaped and an outer end or periphery 128 that is rectangular-shaped, or any other shape for that matter. Inner end 126—which does not have to be oval-shaped and may be circular, rectangular, curved, wave-like, or some other shape instead—is an interior surface or perimeter of cathode 112 that surrounds anode 114 so that the inner end of the cathode opposes an outer end of the anode across the AK gap. In this particular embodiment, inner end 126 includes a pair of straightaway segments 130 and a pair of curved segments 132; the straightaway segments are positioned such that they oppose cavities in the anode across the AK gap, while the curved segments oppose smooth portions of the anode across the AK gap. Although outer end 128 is shown here as being rectangular in shape, it could just as easily be another shape, as this is only one possibility. Cathode 112 is only exemplary and, as explained above, may be provided with many other features, characteristics, embodiments, arrangements, etc. For instance, cathode 112 could be more annular in shape or could be located on the inside of the anode, as will be explained in more detail.

Figure 13:
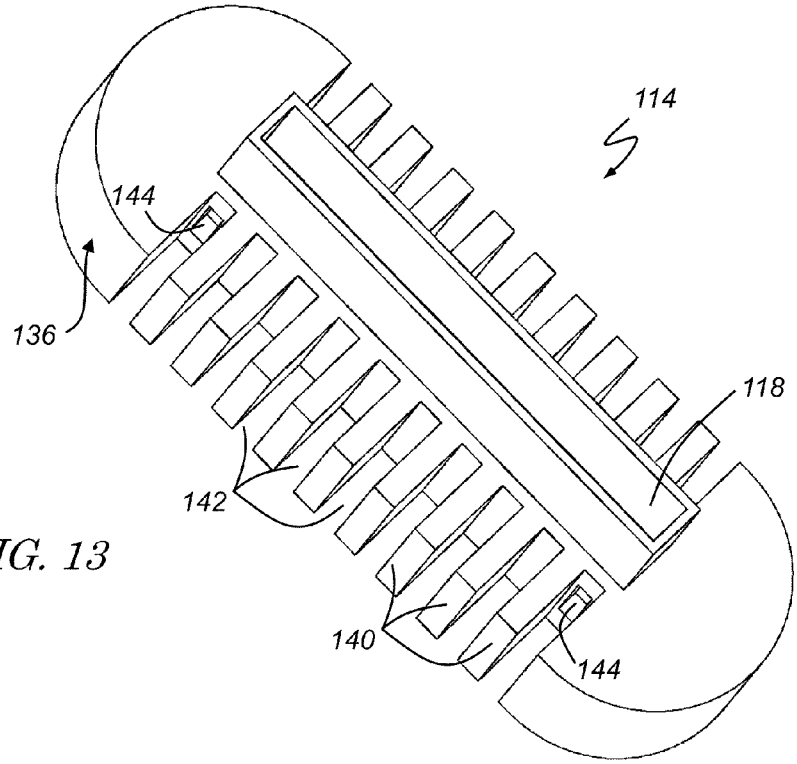
FIG. 13 is a perspective view of an exemplary anode and extraction element that may be used with the crossed field device of FIG. 11.

Anode 114 acts as an electrode in crossed field device 110, and is typically provided with a positive DC or pulsed voltage (relative to cathode 112) so that it can attract the electrons emitted from the cathode. In the exemplary embodiment shown in FIGS. 11-13, anode 114 is generally a flat or planar component and has an outer end or surface 136 that is oval-shaped and helps form the AK gap with the inner end 126 of the cathode, and an inner end or surface 138 that is rectangular-shaped and accommodates an extraction element 118. Outer end 136 of the anode includes a series of projections 140 and cavities 142 located therebetween, and is radially spaced from cathode 112. Projections 140 are shown here as teeth-like or fin-like features that are formed in the side of anode 114 and are positioned along the outer end 136 of the anode so that they oppose straightaway segments 130 of the cathode; that is, cavities 142 are open at an outer end 136 that faces the AK gap. As best illustrated in FIG. 12, projections 140 can be non-tapered such that they and the adjacent cavities 142 have a uniform width B and C, respectively; uniform cavity dimensions may be desirable for promoting certain resonant electromagnetic (EM) fields, as explained above. Some of the cavities 142 shown in FIG. 12 are connected to or communicate with an interior space that accommodates extraction element 118; these cavities are referred to as communicating cavities. This allows electromagnetic (EM) emissions from the communicating cavities (e.g., EM emissions having a frequency of MHz to THz) to be channeled or guided from the communicating cavities, through one or more openings 144 (by either EM electric fields or EM magnetic fields), through extraction element 118, and to a desired load. The size, shape and/or arrangement of cavities 142, openings 144 and/or extraction element 118 may be selected on the basis of the desired electromagnetic (EM) radiation for the device, and certainly can differ from the exemplary embodiment shown here. In one example, cavities 142 have a depth (D) that is less than or equal to one millimeter and enables electromagnetic (EM) emissions that have a frequency greater than or equal to one terahertz (THz). Projections 140 and cavities 142 may be provided with any number of the features, embodiments, attributes, arrangements, etc. described above in connection with projections 40 and cavities 42, for example.

Figure 14:
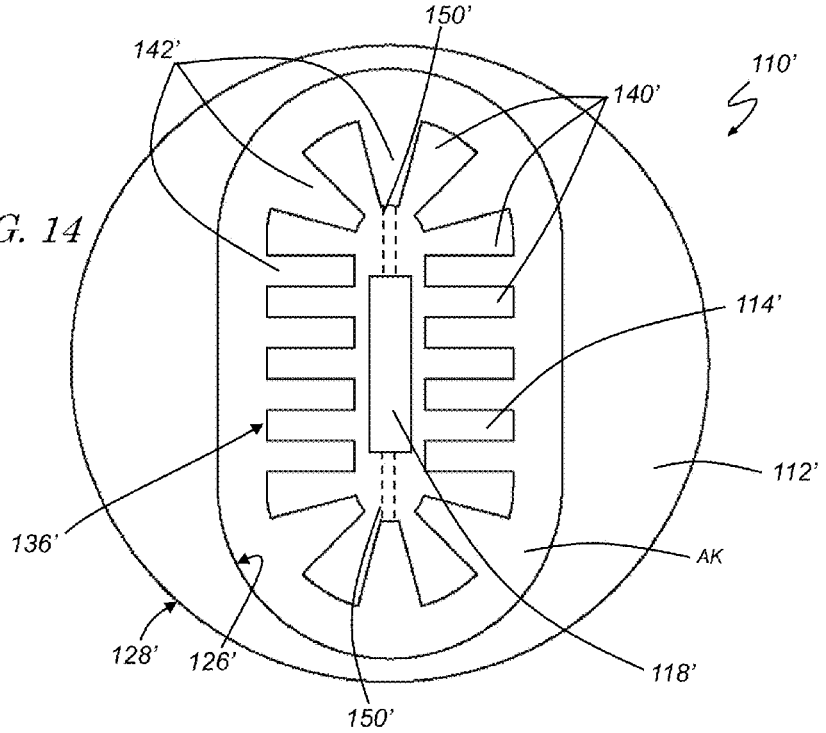
FIG. 14 is a top view of another exemplary cathode/anode that may be used with the crossed field device of FIG. 11, where the anode shown here includes projections and cavities extending all around its periphery.

FIG. 14 illustrates another embodiment of crossed field device 110' where the device is generally planar in shape and generates a radial DC electric field and an axial DC magnetic field, as with the previous embodiment, but has a somewhat different cathode and anode configuration. Cathode 112' has a generally oval inner end 126' (as with the previous embodiment), but has a circular or oval shaped outer end 128' (as opposed to the rectangular shape shown in the previous embodiment). Again, these are only some of the potential configurations for the cathode and anode, as others are certainly possible. Anode 114' has an outer end 136' that is both similar and different to that of the preceding embodiment; outer end 136' is generally oval-shaped like the previous embodiment, however, it has cavities 142' that extend all around the outside of the anode; that is, outer end 136' does not include smooth portions that lack projections and cavities. In the previous embodiment, projections 140 and cavities 142 are only located on straightaway segments 130. In the particular embodiment shown here, some of the cavities 142' are rectangular in shape and have a uniform width, while others are tapered or pie-shaped so that the opening of the cavity is wider than the back of the cavity. Some of the cavities 142' are separated by tapered projections (e.g., those around the curved segments) and some of the cavities 142' are separated by non-tapered projections (e.g., those around the straightaway segments). In addition, a one or more openings 150' may be located at the oval-ends of anode 114', as opposed to being in the middle of the anode, and connect one or more cavities 142' with extraction element 118'. Openings 150' may be constructed as apertures, waveguides, slots, passages, pathways, coupling devices, etc., and may couple EM electric fields or EM magnetic fields. Other differences are also possible.

Magnetic elements 116 generate a DC or pulsed magnetic field, which is crossed with the DC or pulsed electric field that is established between cathode 112 and anode 114. According to the exemplary embodiment shown here, magnetic elements 116 include a set of oval-shaped magnetic coils that are axially located above and below cathode 112 and anode 114, and produce a magnetic B field that is aligned in the axial direction. A first oval-shaped coil is axially spaced above the anode and cathode (i.e., located on a first side of the anode and cathode) and a second oval-shaped coil is axially spaced below the anode and cathode (i.e., located on a second side of the anode and cathode). Of course, magnetic elements 116 do not have to be oval-shaped magnetic coils, but instead could be non-oval shaped magnetic coils, permanent magnets, use pole pieces, or any other suitable magnetic element.

Extraction element 118 channels, guides, directs and/or conducts electromagnetic (EM) emissions from crossed field device 10 to a desired load. According to the exemplary embodiment shown here, extraction element 118 is a rectangular cross-sectional waveguide that is located in the center of anode 114, is coupled to one or more communicating cavities through one or more openings 144, and directs electromagnetic (EM) emissions out of the crossed field device in a generally axial manner. As stated before, communicating cavities are simply cavities 142 that communicate with extraction element 118. It is also possible for opening 144 to be larger than that illustrated here, so that a single opening spans a number of communicating cavities and couples those cavities to extraction element 118 through a single passageway. The location and number of openings 144 may vary, as the resonant RF fields that develop in cavities 142 can dictate or influence the position of the openings. In some embodiments, it may be desirable to locate openings 144 towards the center of the distribution of projections and cavities 140, 142 (as opposed to on the end of the distribution, as in FIGS. 11-13). The resonant RF field strength is sometimes greatest towards the center of the projections and cavities 140, 142, thus, it may make a good location for extracting the electromagnetic (EM) emissions from crossed field device 10. In one example, anode 114 includes a pair of openings 144, where a first opening is located towards the middle of the projections and cavities on one side of the anode and the other opening is located towards the middle of the projections and cavities on the other side of the anode, such that they are evenly spaced from each other around the outer end 136. Other locations and arrangements for openings 144 may be used instead.

The extraction element 118 does not need to be as large as that shown in the drawings, nor does it need to extend from the center of the anode or have a square cross-section as shown in this embodiment. However, providing a large extraction element 118 may be beneficial in that the extraction element does not act as a frequency cutoff limitation, as can occur with smaller waveguides. These and other aspects of the extraction element or waveguide may differ from the exemplary form shown here. For example, extraction elements may include quasi-optical output couplers, folded waveguides, dielectric output couplers, diffraction gaps, ridged waveguides, bowtie waveguides, C- or H-shaped cavities, tapered vanes or projections, coupling loops, photonic bandgap structures, inductive coupling, capacitive coupling, and coaxial transmission lines, to name a few possibilities. The extraction elements may have a variety of different shapes and, in one specific embodiment, could even be parabolic in nature. The extraction elements may be arranged to extract or guide electromagnetic (EM) emissions (including EM electric field or EM magnetic field) from the crossed field device in a generally radial manner, a generally axial manner or according to some other orientation. In one potential arrangement, extraction element 118 includes one or more coaxial transmission lines that are electrically connected to one or more projections 140 of the anode or to some other component of the crossed field device, including components of the anode, cathode, strapping member, etc. Other arrangements are possible as well.

Figure 15:
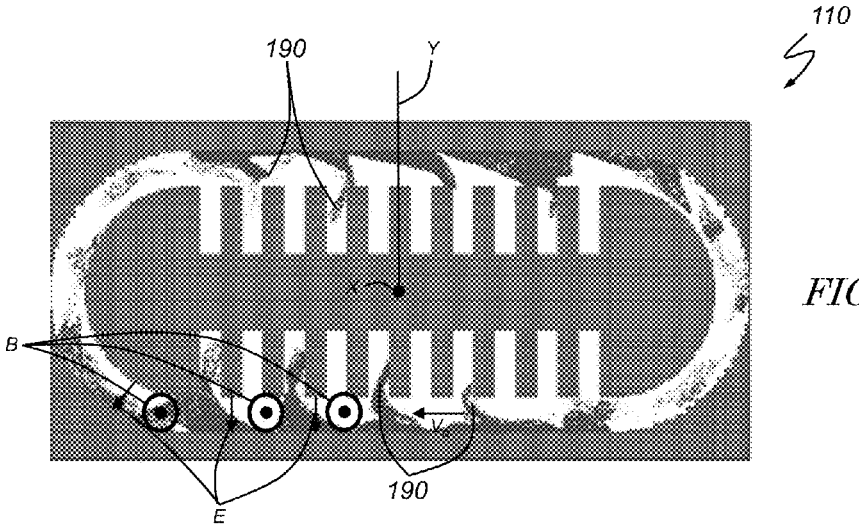
FIG. 15 is an illustration of the crossed field device in FIG. 11 during operation.

During operation, a DC power source may be connected to cathode 112 and/or anode 114 so that a radial electric field is established between these two electrodes. The cathode and/or anode may be provided with a constant voltage, a pulsed voltage, or some other power source in order to establish an electric field that is generally aligned in the radial direction Y of the crossed field device. At the same time, magnetic elements are supplied with an electric current and produce a magnetic field that is generally aligned in the axial direction X of crossed field device 10 (see FIG. 15 for illustrations of these fields). Accordingly, the DC or pulsed electric and magnetic fields oppose one another, with the electric field pushing the electrons from the cathode to the anode and the magnetic field preventing the electrons from actually reaching the anode. The crossed electric and magnetic fields (ExB) cause electrons to spiral between the cathode and anode according to the cycloidal and recirculating flows described above. As the electrons begin to flow around crossed field device 110 in the AK gap (illustrated as $v_0$), they move past cavities 142 and contribute energy to the resonant electromagnetic (EM) fields formed therein. When put together, these various forces act upon the electrons and cause them to bunch together and begin to form spokes or fingers 190. This phenomenon is generally illustrated in FIG. 15, which is a top down view of crossed field device 110.

Figure 16:
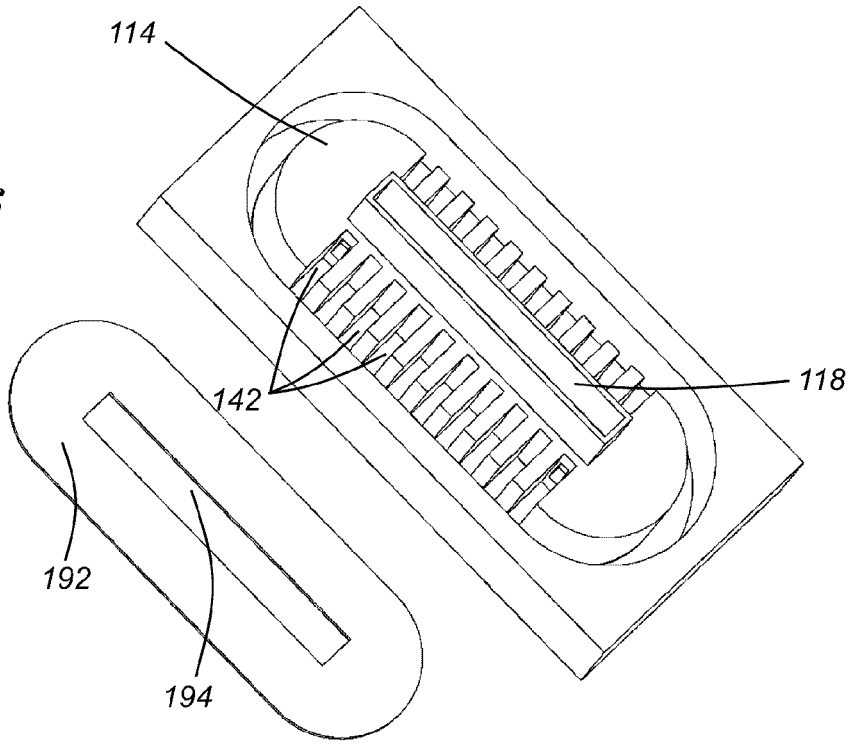
FIG. 16 is a perspective view of the cathode and anode from FIG. 11, and also an exemplary end plate removed from the device for purposes of illustration.
Figure 17:
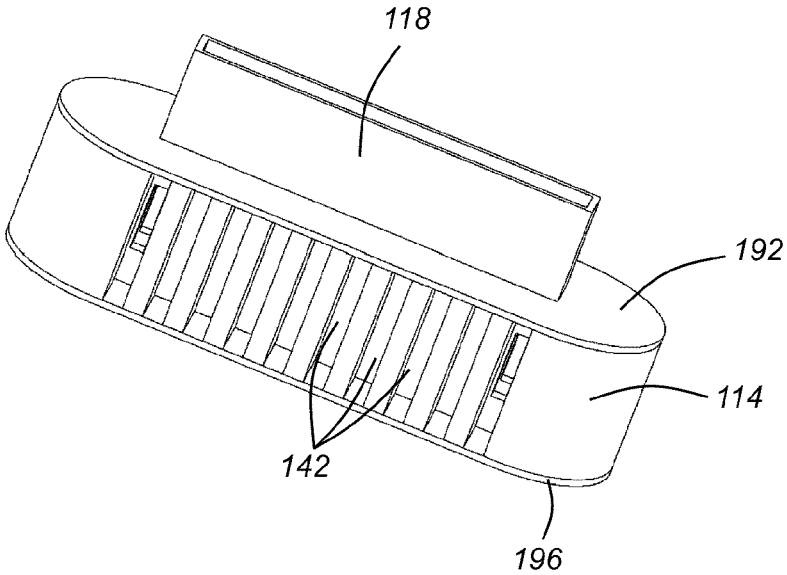
FIG. 17 is a perspective view of the anode from FIG. 11, with the exemplary end plate installed on the anode.

FIGS. 16 and 17 show an exemplary end plate 192 that may be added to an anode in order to encapsulate or otherwise close off some of the sides of the cavities in the anode. As mentioned above, it is possible for cavities 142 to be closed off on the top and/or bottom sides in order to better focus or channel the electromagnetic (EM) fields and emissions that are formed therein and prevent them from flowing out of the lower and/or upper axial ends of the cavities. According to the exemplary embodiment shown here, end plate 192 is a generally oval-shaped plate that is shaped and sized to fit over top of anode 114 and to act as a cap or lid of sorts. This end plate includes a rectangular opening 194 that accommodates extraction element or waveguide 118 and allows it to pass through the plate. It should be appreciated that an end plate, such as that shown here, may be added to one or both sides of anode 114; if a second end plate 196 is added to anode 114 (as in FIG. 17) then an opening for extraction element 118 may not be needed, as the extraction element in this embodiment only extends in one direction. Turning to FIG. 17, there is shown an exemplary embodiment where end plates 192, 196 are attached to anode 114 such that cavities 142 are closed off on five of six sides. Only the radially outer side of the cavity is still open; this enables the electrons to flow in and out of cavities 142 and prevents an undesired leaking of electromagnetic (EM) energy out of the top and bottom of the cavities. Other arrangements and configurations for end plates, anode cavities, etc. are possible, as the aforementioned embodiments are only exemplary. For instance, end plates 192, 196 do not need to directly contact top and bottom surfaces of anode 114, as they could be mounted so that a gap or space is formed between the top and/or bottom of the anode projections and the end plates.

Figure 18:
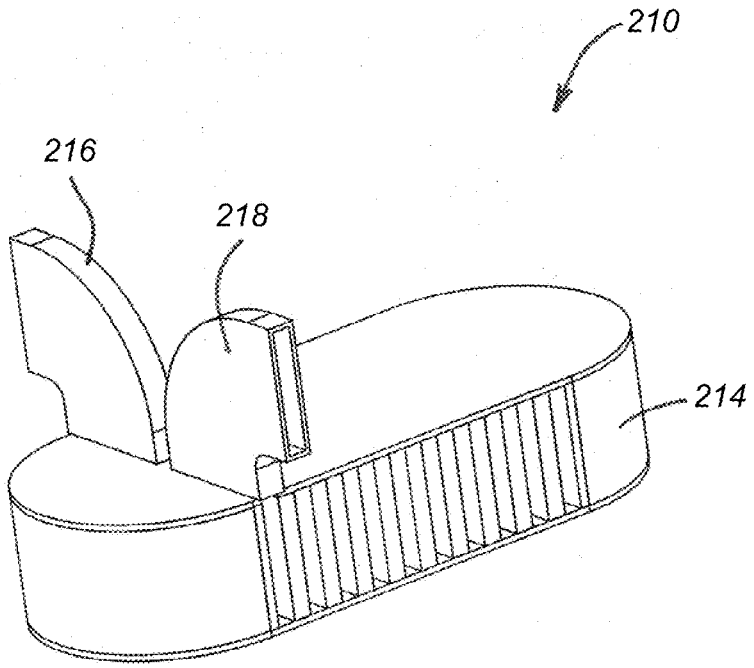
FIG. 18 is perspective view of another exemplary embodiment of a crossed field device, where the device is generally arranged as an amplifier and has the cathode removed for purposes of illustration.
Figure 19:
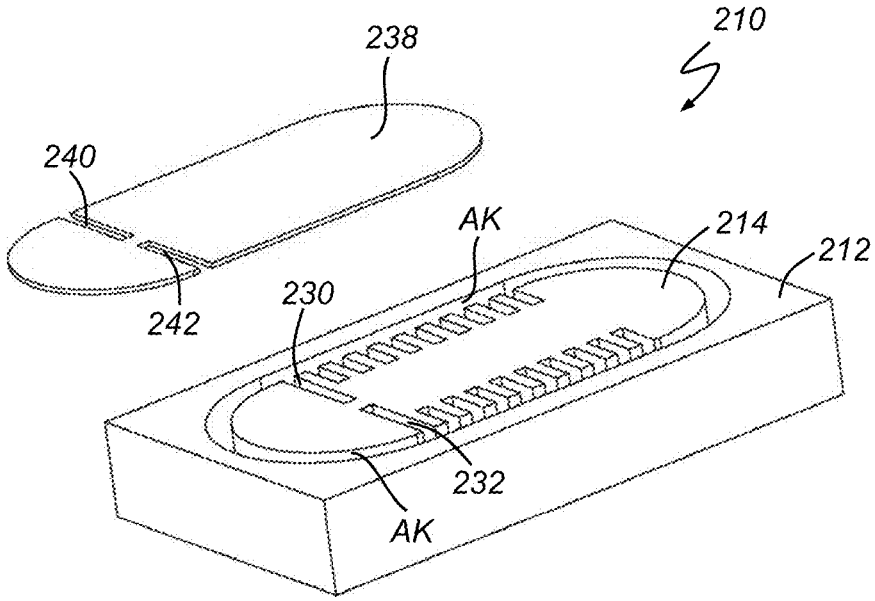
FIG. 19 is a perspective view of the crossed field device from FIG. 16, where an end plate and extraction elements have been removed for purposes of illustration.

With reference to FIGS. 18 and 19, there is shown an exemplary crossed field device 210 that is arranged as an amplifier, as opposed to an oscillator. Crossed field device 210 generally includes a cathode 212, an anode 214, one or more magnetic elements (not shown), and an input waveguide 216 and an output waveguide or extraction element 218. Cathode 212 is somewhat similar to previous examples already described, thus, a separate description is omitted here. Anode 214 has a generally planar and oval shape to it (similar to the previous embodiment), but includes an input slot or opening 230 where input signals enter the device and an output slot or opening 232 where output signals exit the device. More specifically, input signals may be provided to the amplifier through input waveguide 216, input slot 230, and into the AK gap. Once in the AK gap, electrons connected with the input signal circulate around crossed field device 210 in a manner similar to that previously described. As they circulate, they acquire more energy. Thus, an amplified version of the input signal may be extracted through output slot 232 and into output waveguide 218; this is the amplified output signal. Furthermore, an endplate 238 is shown having several cutouts or notches 240, 242 that coincide with output slots 230, 232 and output waveguides 216, 218, respectively. Other configurations and arrangements may be used with the amplifier shown here, as this is only one exemplary embodiment.

Figure 20:
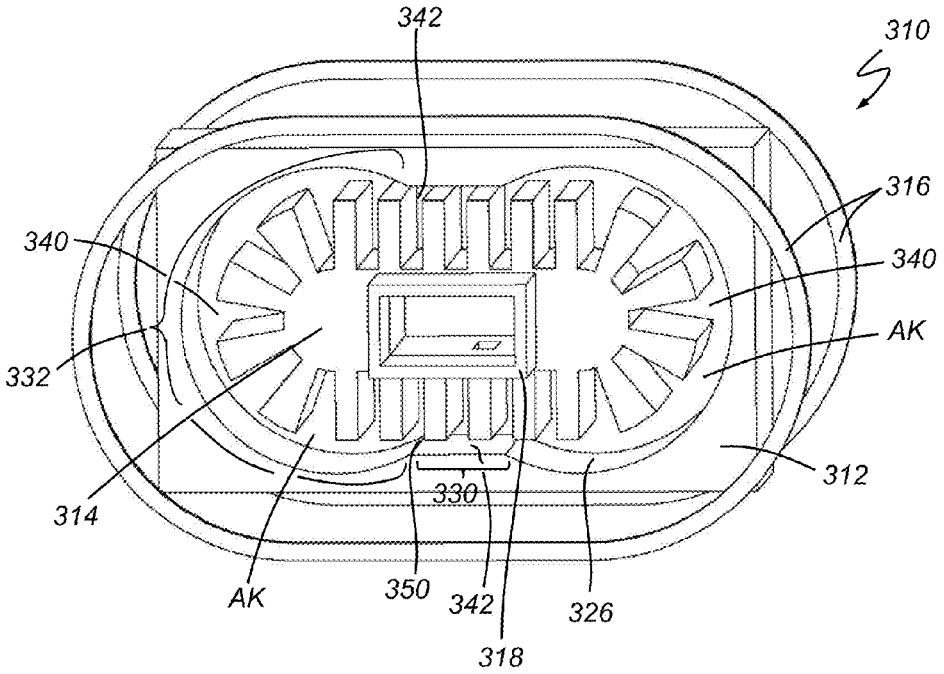
FIG. 20 is a perspective view of another exemplary embodiment of a crossed field device, where the device includes a cathode/anode arrangement with an eyeglass configuration.

According to another exemplary embodiment shown in FIG. 20, a crossed field device 310 includes a cathode 312, an anode 314, one or more magnetic elements 316, and an extraction element 318. Many aspects and features of crossed field device 310 are similar to those shown in FIG. 11, however, cathode 312 has an inner end 326 that is generally formed in an eyeglass configuration so that the AK gap is wider in certain areas and narrower in others. Inner end or surface 326 of the cathode includes a pair of straightaway segments 330 and a pair of curved segments 332, where each curved segment extends for a significant distance around the inner end until it connects with a straightaway segment at a ridge or edge 350. This eyeglass configuration results in an AK gap with non-uniform width and may beneficially influence or manipulate the flow of electrons around the crossed field device. The AK gap has a pair of wider areas 340 (i.e., areas with a wider distance between the opposing walls of the anode and cathode) in the area of curved segments 332, and a pair of narrower areas 342 in the area of straightaway segments 330. Skilled artisans will appreciate that other changes to the inner end or wall 326 of the cathode and/or the outer end or wall 336 of the anode may be made in order to manipulate the AK gap. This includes, for example, providing more straightaway and/or curved segments than shown here.

Figure 21:
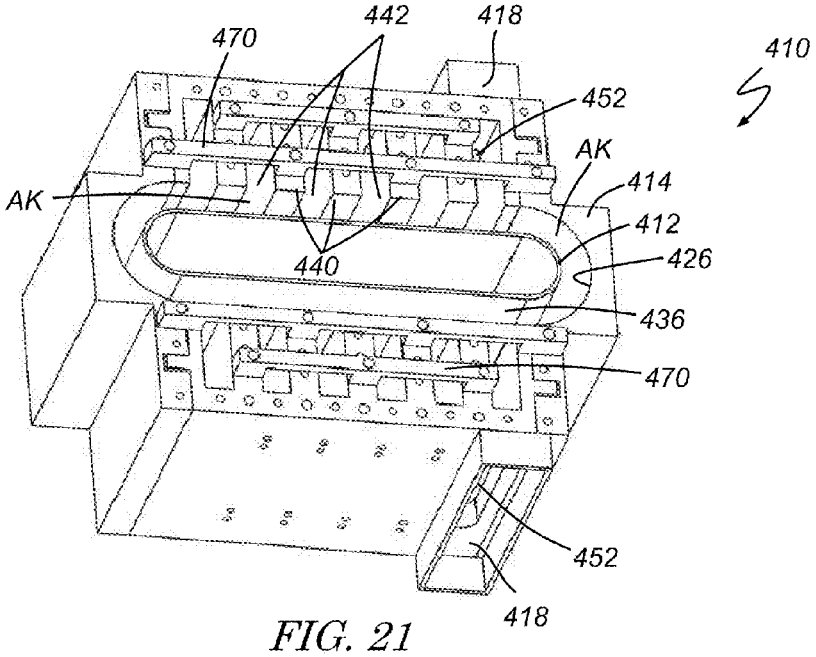
FIG. 21 is a perspective view of another exemplary embodiment of a crossed field device, where the device includes a cathode and anode with relative positions that are reversed with respect to FIG. 11 so that the anode surrounds the cathode.

FIG. 21 shows yet another exemplary embodiment of a crossed field device 410, where this embodiment includes a cathode 412, an anode 414, one or more magnetic elements (not shown), and an extraction element 418. One difference between crossed field device 410 and some of the earlier embodiments is that the relative positions of the cathode and anode have been reversed so that anode 414 surrounds cathode 412, instead of the other way around. According to this exemplary embodiment, cathode 412 is an oval-shaped component that is located in the center of crossed field device 410 and includes an oval-shaped outer end or surface 436 that opposes an inner end or surface 426 of the anode across the AK gap. Outer end or wall 436, like some of the earlier embodiments, includes both straightaway segments and curved segments and is designed to interact with anode 414 in the manner already described. Cathode 412 is shown here as a hollow component, but it could just as easily be a solid component as well. Anode 414 surrounds cathode 412 and includes an inner end or wall 426 with a number of projections and cavities 440, 442 formed thereon. In this particular example, the projections and cavities are only located on portions of inner end 426 that oppose straightaway segments of the cathode, however, it is possible for them to extend all the way around the inner end of the anode instead. Cathode 412 and/or anode 414 may be altered so that crossed field device 410 has more of an eyeglass configuration with a non-uniform AK gap, as shown in FIG. 20 and described above. Extraction element 418 includes a pair of waveguides that are located on the outside of anode 414 and are coupled to communicating cavities 442 through openings 452. One of these waveguides may receive input signals, while the other waveguide may direct electromagnetic (EM) emissions out of the crossed field device in a generally radial manner. The number, shape, configuration, location, orientation, etc. of the waveguides or extraction element 418 may differ from the exemplary embodiment shown here.

One optional feature of crossed field device 410 is the pair of strapping elements 470, which are conductive parts that may extend across multiple cavities 442 and connect together different projections 440. By electrically connecting two or more projections together, strapping elements 470 can affect the electromagnetic (EM) fields in the cavities and therefore influence the electron flow around the crossed field device, as is appreciated by those skilled in the art. The location of openings 452 and the placement of strapping elements 470 may be coordinated to produce an optimum output. As mentioned previously, it is also possible to electrically connect an extraction element like a coaxial transmission line directly to strapping element 470.

It is to be understood that the foregoing description is of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, the projections and/or cavities in the anode could be replaced with electromagnetic structures, circuits or the like. Some examples include traveling wave structures, slow wave structures, meander lines, and folded waveguides, to name but a few. This is true with both the oscillator and amplifier embodiments, as it is not necessary for the anode to use cavities as shown here, and instead may have some other type of feature that slows down the waves circulating around the crossed field device. All such other embodiments, changes, and modifications are intended to come within the scope of the appended claims.

As used in this specification and claims, the terms "for example," "for instance," and "such as," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A crossed field device for generating electromagnetic (EM) emissions, comprising:

a cathode that geometrically includes an axial direction and a radial direction that is normal to the axial direction, the cathode having an axial end that faces the axial direction;

an anode being spaced from the cathode in the axial direction, the anode having a plurality of cavities and an axial end that faces the axial end of the cathode across an AK gap;

a magnetic element; and an extraction element conveying the electromagnetic (EM) emissions from the crossed field device to an intended load, wherein the crossed field device is a recirculating device that creates an electric (E) field extending in the axial direction across the AK gap and a magnetic (B) field that extends in the radial direction through the AK gap.

2. The crossed field device of claim 1, wherein the cathode is an annular component that emits electrons from its axial end across the AK gap.

3. The crossed field device of claim 2, wherein the cathode includes one or more electron emission element(s) for emitting electrons, and wherein the electron emission element(s) are located on the axial end of the cathode that faces the AK gap and generally extend in the radial direction.

4. The crossed field device of claim 1, wherein the anode is an annular component that attracts electrons, and wherein the axial end of the anode includes a plurality of projections interspaced with the plurality of cavities whereby the AK gap is located between the cathode and the plurality of projections.

5. The crossed field device of claim 4, wherein the projections are tapered so that an inner radial end of the projection is narrower than an outer radial end of the projection.

6. The crossed field device of claim 4, wherein the cavities are open at an inner radial end and/or an outer radial end so that some of the electromagnetic (EM) emissions in the crossed field device can flow out of the inner and/or outer radial ends of the cavities.

7. The crossed field device of claim 4, wherein the cavities are closed off at an inner radial end and/or an outer radial end so that the electromagnetic (EM) emissions in the crossed field device are prevented from flowing out of the inner and/or outer radial ends of the cavities.

8. The crossed field device of claim 4, wherein the cavities have a generally rectangular shape with an axial depth (D) that is less than or equal to 1 millimeter, and the crossed field device generates electromagnetic (EM) emissions having a frequency greater than or equal to 1 tera hertz (THz).

9. The crossed field device of claim 1, wherein the magnetic element includes a first disk-shaped coil and a first ring-shaped coil that are axially spaced outboard of the cathode, and a second disk shaped coil and a second ring shaped coil that are axially spaced outboard of the anode, wherein the coils, the cathode, and the anode are all generally coaxial with one another.

10. The crossed field device of claim 1, wherein the extraction element includes a waveguide coupled to a communicating cavity of the anode through an opening in an axial end of the anode that is spaced away from the AK gap, and the waveguide conveys electromagnetic (EM) emissions out of the crossed field device.

11. The crossed field device of claim 10, wherein the extraction element includes a plurality of waveguides coupled to a plurality of communicating cavities, and each communicating cavity is located next to one or more non-communicating cavities and helps promote a pi-mode operation in the crossed field device.

12. The crossed field device of claim 1, wherein the extraction element includes a cylindrical sleeve coupled to at least one communicating cavity of the anode through an opening in an axial end of the anode that is spaced away from the AK gap, and the cylindrical sleeve conveys electromagnetic (EM) emissions out of the crossed field device.

13. The crossed field device of claim 1, wherein the extraction element includes a cylindrical sleeve coupled to at least one communicating cavity of the anode through an opening in an inner radial end or an opening in an outer radial end of the anode, and the cylindrical sleeve conveys electromagnetic (EM) emissions out of the crossed field device.

14. The crossed field device of claim 1, wherein the extraction element includes a coaxial transmission line coupled to a component of the anode, and the coaxial transmission line conveys electromagnetic (EM) emissions out of the crossed field device.

15. The crossed field device of claim 1, further comprising inner and outer electron reflectors for influencing electrons to stay within the AK gap, wherein the inner and outer electron reflectors are electrically-insulated from the anode, are annular in shape, and are located at inner and outer radial ends of the anode, respectively.

16. The crossed field device of claim 1, wherein the crossed field device is an amplifier and includes an input waveguide for receiving an input signal and the extraction element for providing an amplified output signal, and the input waveguide and the extraction element are coupled to different cavities in the anode.

17. The crossed field device of claim 1, wherein the anode and the cathode have a thickness in the axial direction that is less than or equal to the wavelength (λ) of the includes a plurality of projections and a plurality of cavities that promote resonant electromagnetic (EM) fields in the crossed field device.

18. A crossed field device for generating electromagnetic (EM) emissions, comprising:

a cathode;

an anode being radially spaced from the cathode and having a plurality of cavities, at least one of the cathode and/or the anode is generally oval-shaped;

a magnetic element; and an extraction element conveying the electromagnetic (EM) emissions from the crossed field device to an intended load, wherein the crossed field device is a recirculating device that creates a radial electric (E) field and an axial magnetic (B) field;

wherein the anode surrounds the cathode and attracts electrons with an inner end that faces an outer end of the cathode across an AK gap; and wherein the inner end of the anode includes a plurality of projections and a plurality of cavities that promote resonant electromagnetic (EM) fields in the crossed field device, and the outer end of the cathode is oval-shaped and includes one or more straightaway segments and one or more curved segments.

19. The crossed field device of claim 18, wherein the straightaway segments and the curved segments are arranged so that the AK gap is wider in the area of the curved segments and is narrower in the area of the straightaway segments.

20. The crossed field device of claim 18, wherein the extraction element includes a waveguide that is located on the outside of the anode and is coupled to a electromagnetic (EM) emissions produced by the crossed field device such that the crossed field device is a planar device.

21. The crossed field device of claim 18, wherein the anode includes one or more smooth portions with no projections or cavities, and each smooth portion of the anode generally opposes a curved segment of the cathode.

22. The crossed field device of claim 18, wherein some of the cavities are separated by tapered projections and some of the cavities are separated by non-tapered projections.

23. The crossed field device of claim 18, wherein the cavities are closed off at a lower axial end and/or an upper axial end with an endplate so that the electromagnetic (EM) emissions in the crossed field device are prevented from flowing out of the lower and/or upper axial ends of the cavities.

24. The crossed field device of claim 18, wherein the cavities have a generally rectangular shape with an axial depth (D) that is less than or equal to 1 millimeter, and the crossed field device generates electromagnetic (EM) emissions having a frequency greater than or equal to 1 tera hertz (THz).

25. The crossed field device of claim 18, wherein the magnetic element includes a first oval-shaped coil that is axially spaced on a first side of the cathode and anode, and a second oval-shaped coil that is axially spaced on a second side of the cathode and anode.

26. The crossed field device of claim 18, wherein the crossed field device is an amplifier and includes an input waveguide for receiving an input signal and the extraction element for providing an amplified output signal, and the input waveguide and the extraction element are coupled to different cavities in the anode.

27. The crossed field device of claim 18, wherein the crossed field device is an oscillator and wherein the extraction element is coupled to one or more of the cavities in the anode.

28. The crossed field device of claim 18, further comprising a strapping element extending across two or more cavities of the anode and connecting together two or more projections of the anode.

29. The crossed field device of claim 18, wherein the extraction element includes a coaxial transmission line coupled to a component of the anode, and the coaxial transmission line conveys electromagnetic (EM) emissions out of the crossed field device.

30. The crossed field device of claim 18, wherein the anode and the cathode have a thickness in the axial direction that is less than or equal to the wavelength ($\lambda$) of the electromagnetic (EM) emissions produced by the crossed field device such that the crossed field device is a planar device.

31. A crossed field device for generating electromagnetic (EM) emissions, comprising:

a cathode;

an anode being radially spaced from the cathode and having a plurality of cavities; and an extraction element conveying the electromagnetic (EM) emissions from the crossed field device to an intended load, wherein the crossed field device is a recirculating device that creates a radial electric (E) field and an axial magnetic (B) field;

wherein the cathode surrounds the anode and emits electrons from an inner end that faces an outer end of the anode across an AK gap; and wherein the inner end of the cathode is oval-shaped and includes one or more straightaway segments and one or more curved segments, and the outer end of the anode communicating cavity in the anode through an opening, and the waveguide conveys electromagnetic (EM) emissions out of the crossed field device.

32. The crossed field device of claim 31, wherein the straightaway segments and the curved segments are generally arranged in an eyeglass configuration so that the AK gap is wider in the area of the curved segments and is narrower in the area of the straightaway segments.

33. The crossed field device of claim 31, wherein the extraction element includes a waveguide that is located in the center of the anode and is coupled to a communicating cavity of the anode through an opening, and the waveguide directs electromagnetic (EM) emissions out of the crossed field device.

34. The crossed field device of claim 33, wherein a single opening spans a plurality of communicating cavities so that the waveguide is coupled to the plurality of communicating cavities through the single opening.

* * * * *